US005376886A

United States Patent [19]

Shimasaki et al.

[11] Patent Number: 5,376,886

[45] Date of Patent: Dec. 27, 1994

[54] IGNITION DISTRIBUTOR CAP WITH MISFIRE DETECTING CAPACITOR FOR INTERNAL COMBUSTION ENGINE

[75] Inventors: Yuichi Shimasaki; Shigeru Maruyama; Masaki Kanehiro; Takashi Hisaki; Shigeki Baba; Takuji Ishioka, all of Saitama, Japan

[73] Assignee: Honda Giken Kogyo Kabushiki Kaisha, Tokyo, Japan

[21] Appl. No.: 12,433

[22] Filed: Feb. 2, 1993

[30] Foreign Application Priority Data

Feb. 6, 1992 [JP] Japan ..... 4-056394
Apr. 28, 1992 [JP] Japan ..... 4-136248

[51] Int. Cl.[5] ..... F02P 17/00
[52] U.S. Cl. ..... 324/402; 73/116
[58] Field of Search ..... 324/385, 402, 388, 392, 324/548, 72.5, 457, 390, 391, 393–395, 399; 73/116, 117.3

[56] References Cited

U.S. PATENT DOCUMENTS 3,543,572 12/1970 Summerer et al. ..... 324/385
4,008,430 2/1977 Blum ..... 324/402
4,090,130 5/1978 Willenbecher, Jr. ..... 324/126
5,237,278 8/1993 Bumen ..... 324/402

FOREIGN PATENT DOCUMENTS 52-118135 10/1977 Japan .
3-326509 11/1991 Japan .

*Primary Examiner*—Kenneth A. Wieder
*Assistant Examiner*—J. M. Patidar
*Attorney, Agent, or Firm*—Nikaido, Marmelstein, Murray & Oram

[57] ABSTRACT

An ignition distributor cap having a first capacitor for detecting ignition voltage of a spark-ignition internal combustion engine to determine if misfire occurs. The ignition distributor cap has a coil contact tower connected to the secondary winding of an ignition coil of the engine, spark plug terminals connected to spark plugs of the engine, and a rotor connecting the coil contact tower to one of the spark plug terminals with a gap to generate an electric path carrying ignition voltage current produced at the ignition coil to the spark plug. In the ignition distributor cap, a conductor is located around the electric path keeping a predetermined distance from the electric path and forming a first capacitor such that the first capacitor constitutes a capacitive divider with a second capacitor for ignition voltage detection between the electric path and the conductor positioned at the coil contact tower or the individual spark plug terminals. A ceramic insulator can be positioned between the conductor and the electric path. The conductor can further be electrically shielded.

19 Claims, 9 Drawing Sheets

IGNITION DISTRIBUTOR CAP WITH MISFIRE DETECTING CAPACITOR FOR INTERNAL COMBUSTION ENGINE

BACKGROUND OF THE INVENTION

1. Field of the Invention

This invention relates to a technology for detecting misfire occurring during operation of a gasoline or other spark-ignition internal combustion engine and more particularly to an ignition distributor cap with a capacitor for detecting misfire for an internal combustion engine.

2. Description of the Prior Art

As is well known, in gasoline and other types of internal combustion engines a high voltage produced by an ignition coil is distributed to spark plugs at the engine cylinders by an ignition distributor or the like. At each cylinder, the resulting electric discharge between the spark plug electrodes produces a spark which ignites an air-fuel mixture that has been drawn into the cylinder and compressed at the proper time, causing the mixture to burn explosively. In the course of this ignition-combustion process in the internal combustion engine, the mixture may for some reason occasionally fail to burn properly. This is referred to as a misfire. Misfires can result from causes in either the fuel system or the ignition system. Misfires caused by problems in the fuel system are the result of an overly lean or overly rich air-fuel mixture. A spark is produced between the spark plug electrodes but the air-fuel mixture does not ignite. Misfires caused by problems in the ignition system are the result of spark plug electrode fouling or ignition circuit malfunctions which prevent normal spark discharge.

The occurrence of misfire in the course of engine operation not only degrades engine performance but may also cause after-firing of unburned gases in the exhaust system, which can damage the exhaust gas aftertreatment system and have other adverse effects. Moreover, since the occurrence of even a single misfire indicates a misadjustment or malfunction in the fuel or ignition system, prompt elimination of the problem is essential. Because of this, there is a strong need for development of a detector for detecting misfires as soon as they occur.

Only type of misfire detector that has been proposed is the mis-spark detector described in Japanese Laid-open Patent Publication No. 52(1977)-118135. As shown in FIG. 9, the detector includes a conductor 51 wrapped around a portion of a high-voltage (high tension) cable 50 of the engine ignition system so as to constitute a detection capacitor 52 (a type of capacitance probe) in which the insulation cladding 50A of the high-voltage cable 50 serves as the dielectric. A voltage divider capacitor 53 is connected between the capacitor 52 and ground so that the ignition voltage (secondary voltage of the ignition coil) applied to the conductive core 50B of the high-voltage cable 50 induces a voltage across the terminals of the capacitor 52 owing to its static capacitance. The induced voltage is statically divided by the capacitor 52 and the capacitor 53, and the voltage across the terminals of the capacitor 53 (the divided voltage) is forwarded as a detection voltage to an electronic circuit 54 for processing and discrimination. The electronic circuit 54 discriminates the occurrence of misfires from the difference between the wave form of the ignition voltage at the time of normal spark discharge and that at the time of no spark discharge (mis-sparking). Among the different types of misfires, the detector thus detects misfires that occur when no spark discharge is produced owing to a problem in the ignition system.

Another detector for detecting misfire in internal combustion engines is disclosed in the present assignee's Japanese Patent Application No. 3(1991)326509. In this detector, the ignition voltage is similarly detected from a high-voltage division, and misfire owing to causes in the fuel system is detected based on the fact that, even when spark discharge occurs, the wave form of the ignition voltage differs between the case where normal combustion occurs and the case where it does not.

In the conventional misfire detectors, as the means for detecting ignition voltage there is usually used a so-called capacitance probe constituted by wrapping a sheet or ribbon of conductor around the high-voltage cable of the ignition system so as to form a detection capacitor between the conductor and the core of the high-voltage cable via the insulation cladding of the high-voltage cable as the dielectric. However, the capacitance probe constituted in this manner has a major drawback that derives from the nature of the high-voltage cable of the ignition system. Because of its flexibility and elasticity, the high-voltage cable is highly susceptible to vibration. It is also easily affected by changes in the ambient humidity, wetting by leaking water, and fouling with oil, grime and the like. When a capacitor for use in detection is formed by wrapping a conductor ribbon around the cable, the static capacitance of the capacitor is apt to be changed from the proper value by shifting of the conductor caused by vibration as well as by changes in humidity, wetting with water and fouling with oil, grime and the like. Although some change in static capacitance can be tolerated if the capacitor is to be used only for checking the ignition voltage, even slight changes have to be avoided when it is used for misfire discrimination because such discrimination generally requires accurate detection not only of the ignition voltage but also of the ignition voltage wave form. The capacitance changes to which the prior art capacitance probe is susceptible degrade the detected voltage wave form and make it impossible to discriminate misfire with high reliability.

In addition, the insulation cladding of the high-voltage cable is generally formed of synthetic rubber, a material that is readily degraded when exposed to heat and fouling with oil and grime. This degradation of the insulation cladding after the detection capacitor has been formed by winding the conductor around the high-voltage cord not only produces a progressive change in the static capacitance of the capacitor over time but also increases the risk of electric insulation breakdown. In this latter case, the high ignition voltage can leak to the conductor wrapped thereon. When this happens, the high leak voltage is apt to be conducted to the electronic circuitry of the misfire detector, which it can damage or cause to malfunction.

In actual practice, moreover, the flexibility and elasticity of the high-voltage cable make the work of attaching the conductor for forming the capacitor on the insulation cladding of the high-voltage cable difficult and troublesome. Maintenance of the so-formed capacitor is also troublesome.

On the other hand, when normal combustion does not occur and ions are therefore not produced at the gap between the spark plug electrodes, natural discharge between the electrodes does not proceed smoothly following insulation breakdown. Instead, the charge developed between the electrodes may flow through the ignition system in reverse. This produces changes in the voltage wave form detected by the detection capacitor or other voltage detection means of the misfire detector and makes it impossible to discriminate the presence/absence of misfire accurately.

The engine compartments of most modern cars are tightly packed with various devices, components and wiring. In providing the detection capacitor of a misfire detector, the conductor for detection constituting a part of the detection capacitor generally ends up being close to some other electrically conductive component. In this case, any change in the distance between the conductor for detection and the nearby conductive component will substantially change the capacitance of the detection capacitor. In addition, the detection capacitor will pick up noise from the nearby conductive component. Since any such change in capacitance or introduction of a noise component adversely affects the ignition voltage wave form detected by the detection capacitor, the detection accuracy is degraded.

SUMMARY OF THE INVENTION

This invention was accomplished in light of the foregoing circumstances and has as its basic object to provide an ignition distributor cap with a capacitor for a spark-ignition internal combustion engine for detecting misfire of an ignition system, which enables the static capacitance of the capacitance probe to be maintained constant, unaffected by mechanical vibration, humidity changes, water-wetting and the like, and also enables a high degree of freedom from the insulation degradation, thus ensuring accurate detection of even the voltage wave form, and which is also easy to install and maintain.

Another object of the invention is to provide an ignition distributor cap with a misfire detecting capacitor for a spark-ignition internal combustion engine which prevents degradation of the accuracy of ignition voltage wave form detection owing to substantial change in the capacitance of the detection capacitor or to picked-up noise, even when the conductor for detection constituting a part of the detection capacitor is located in the vicinity of another electrically conductive member.

Still another object of the invention is to provide an ignition distributor cap with a misfire detecting capacitor for a spark-ignition internal combustion engine which prevents the detected voltage wave form from being changed by a current flowing through the ignition system in reverse owing to residual charge between the spark plug electrodes at the time of misfire and which thus enables the presence/absence of misfire to be reliably discriminated from the detected voltage wave form.

For realizing these objects, the present invention provides an ignition distributor cap covering the ignition distributor and having a coil contact tower connected to the secondary winding of an ignition coil of the engine, spark plug terminals connected to spark plugs of the engine and a rotor connecting the coil contact tower to one of the spark plug terminal with a gap to generate an electric path carrying ignition voltage current produced at the ignition coil to the spark plug. In the cap, a conductor is located around the electric path keeping a predetermined distance from the electric path and sandwiching an insulator such that a capacitor, which constitutes a capacitive divider with a capacitor for ignition voltage detection, is formed between the electric path and the connector.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

For easier understanding of the invention, the explanation of specific embodiments of the ignition distributor cap according to the invention will be preceded by an explanation of a typical conventional ignition distributor cap.

Figure 7:
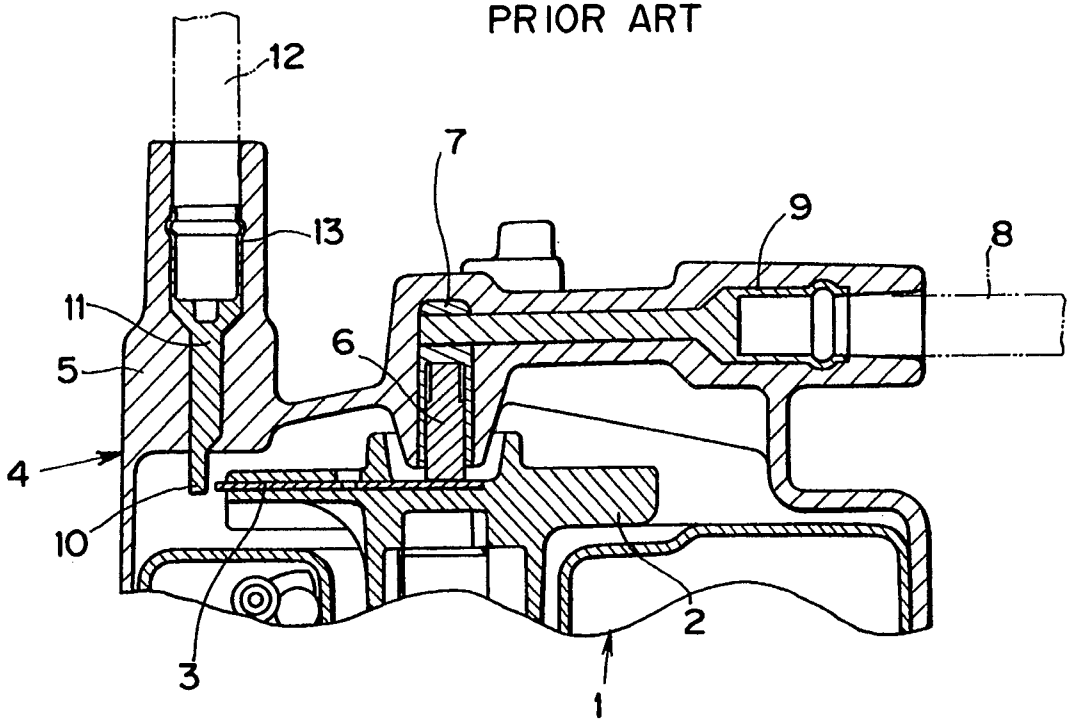
FIG. 7 PRIOR ART
FIG. 7 is a vertical sectional view of a conventional prior art ignition distributor cap, also showing a part of the main distributor unit.
Figure 8:
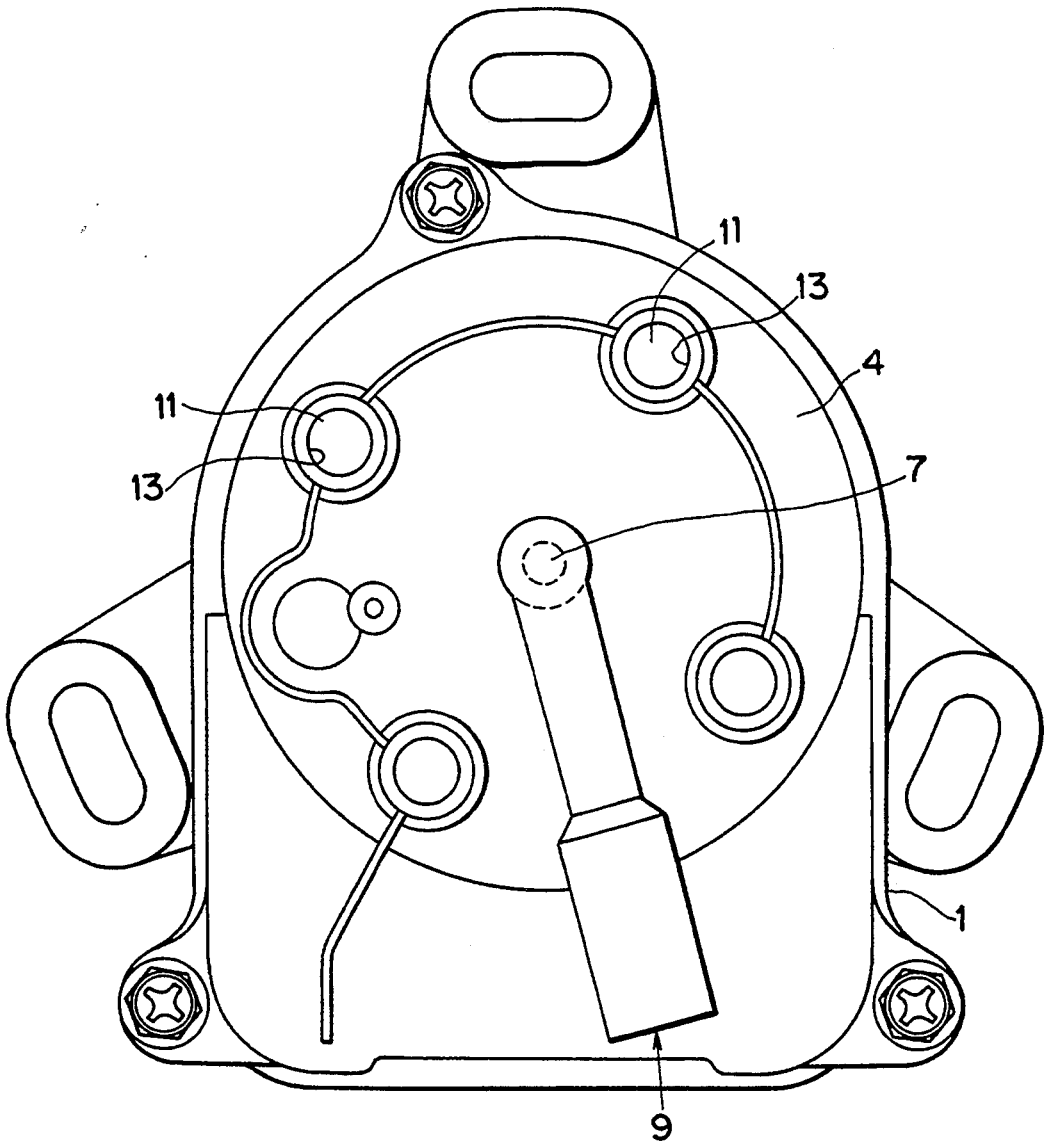
FIG. 8 PRIOR ART
FIG. 8 is a plan view of the ignition distributor cap of FIG. 7.
Figure 9:
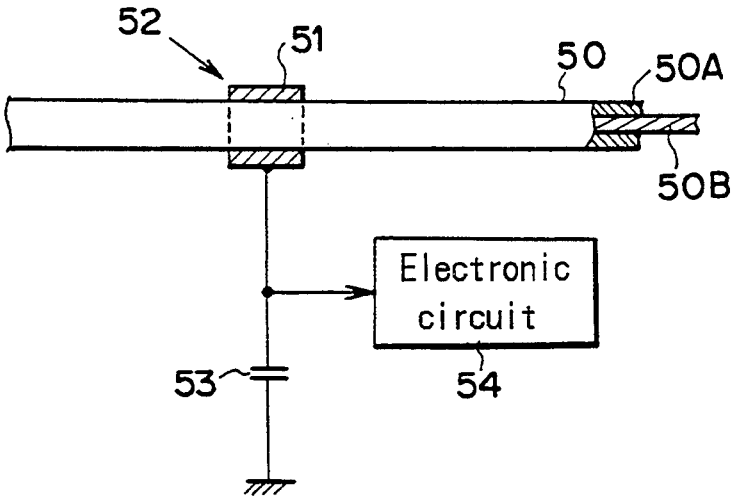
FIG. 9 PRIOR ART
FIG. 9 is a schematic view showing the voltage detection means of a prior art misfire detector.

FIGS. 7 and 8 show the structure in the vicinity of the cap portion of a typical prior art ignition distributor. In FIG. 7, the main distributor unit 1 at the bottom is equipped with a distributor rotor 2 that is rotated at a prescribed speed. A rotor terminal 3 projects laterally from the center of the distributor rotor 2. An ignition distributor cap 4 is attached to the main distributor unit 1 so as to cover its whole upper side. The ignition distributor cap 4 comprises a cap body 5 integrally molded of polybutylene terephthalate (PBT) or other hard or rigid resin exhibiting excellent heat resistance and electrical insulation property. A center terminal section (the so-called coil contact tower) 7 and side terminal sections (the so-called spark plug terminals) 11, both to be explained below, are integrally embedded into the cap body 5.

The center terminal section (coil contact tower) 7, which is provided on its bottom with a center electrode 6 in contact with the center of the rotor terminal 3, is provided at the center of the ignition distributor cap 4. The upper end of the center terminal section 7 has a lateral extension formed with an input side connector 9 for insertion of the tip of a high-voltage cable 8 from the secondary winding of an ignition coil (not shown). On the other hand, the periphery of the ignition distributor cap 4 is provided with a plurality of side terminal sections (spark plug terminals) 11 each equipped with a side terminal 10 facing the lateral extremity of the rotor terminal 3. The upper part of each side terminal section 11 is formed with an output side connector 13 for insertion of one end of a high-voltage (high tension) cable 12 whose other end is connected with a spark plug (not shown). As mentioned earlier, the center terminal section 7 and the side terminal sections 11 are integrally embedded into the resin at the time of forming the cap body 5.

In the ignition distributor cap 4 of the conventional structure shown in FIGS. 7 and 8, the high-voltage cable 8 conducts high-voltage current for spark discharge from the secondary winding of the ignition coil (not shown) to the input side connector 9, from where it passes through the center terminal section 7 and the center electrode 6 to the rotor terminal 3. As the rotor terminal 3 rotates, the high-voltage current flows across the gap between the rotor terminal 3 and each successive side terminal 10 to be successively distributed to the side terminal sections 11. At each side terminal section 11, it passes through the output side connector 13 to the high-voltage cable 12, which conducts it to the associated spark plug.

Figure 1:
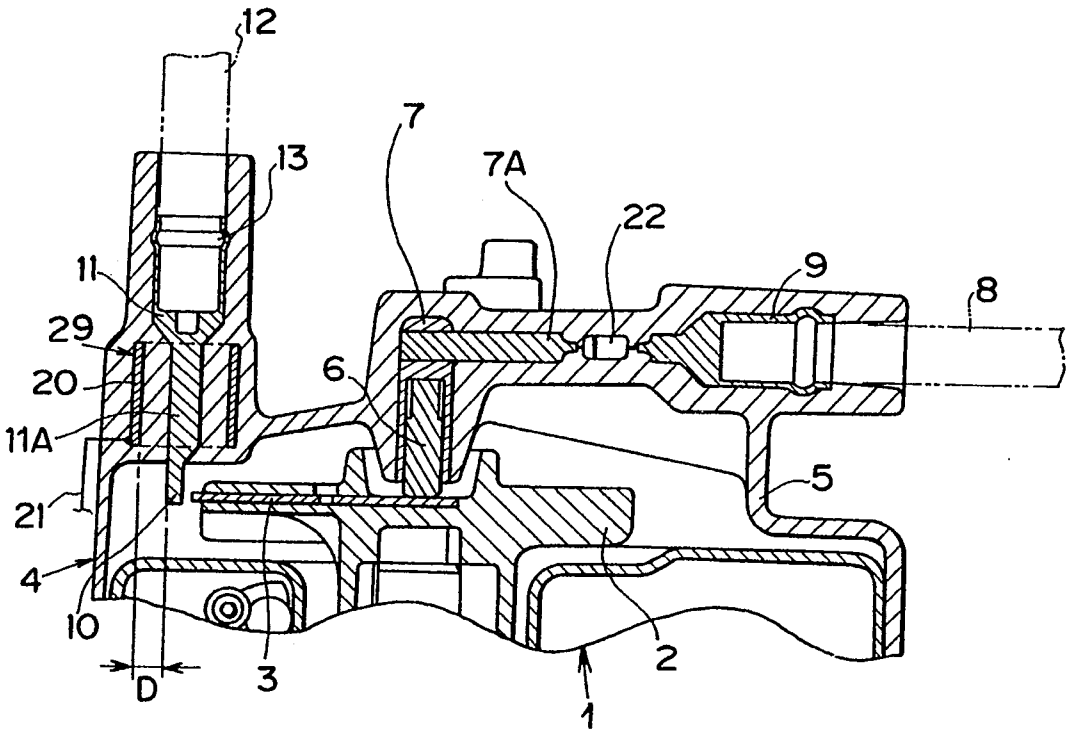
FIG. 1 is a vertical sectional view of an ignition distributor cap with a misfire detecting capacitor for a spark-ignition internal combustion engine according a first embodiment of the invention, also showing a part of the main distributor unit.

FIG. 1 shows a first embodiment of the ignition distributor cap configuration according to this invention applied to a distributor cap structure similar to that shown in FIG. 7. While, as was mentioned earlier, the conductor for detection can be disposed at any point on the high-voltage conduction path extending between the input side connector 9 and the individual output side connectors 13, in this first embodiment it is disposed as conductor 20 on conduction path segment of the side terminal sections (spark plug terminals) 11 (the conduction path segment closer to the output side connectors 13). Elements in FIG. 1 which correspond to those in FIGS. 7 and 8 are assigned identical reference symbols to their counterparts in FIGS. 7 and 8 and will not be explained further.

In the embodiment of FIG. 1, a conductor 20 for detection formed of a good conductor material such as copper or aluminum to have the shape of a hollow tube, a half tube(s) or a split tube(s) is disposed around a conductor 11A for high-voltage conduction on the side terminal sections (spark plug terminals) 11. More specifically, the conductor 20 is disposed around each conductor 11A so as to enclose the same between the side terminal 10 and the output side connector 13. Since the conductor 20 is integrally embedded in the resin of the cap body 5 at the time the cap body 5 is formed, a portion of the resin constituting cap body 5 is present between the inner surface of the conductor 20 and the conductor 11A. A lead 21 is connected with the conductor 20 for enabling voltage to be conducted to the exterior of the cap body 5. On the other hand, a current suppression means 22 (e.g. a diode 22) is inserted into the high-voltage conductor path segment 7A at the center terminal section (coil contact tower) 7 (the high-voltage conductor path segment 7A being the part of the high-voltage conduction path between the input side connector 9 and the center electrode 6). The diode 22 is for suppressing the flow of current in the direction from the center electrode 6 toward the input side connector 9 (i.e. current flow from the spark plug toward the ignition coil). The diode 22 is embedded in the resin of the cap body 5 at the time the cap body 5 is formed.

In the configuration shown in FIG. 1, the conductor 11A of the each terminal section 11 and the conductor 20 surrounding it constitute a detection capacitor 29 which has the intervening resin (insulator) as its dielectric.

Figure 2:
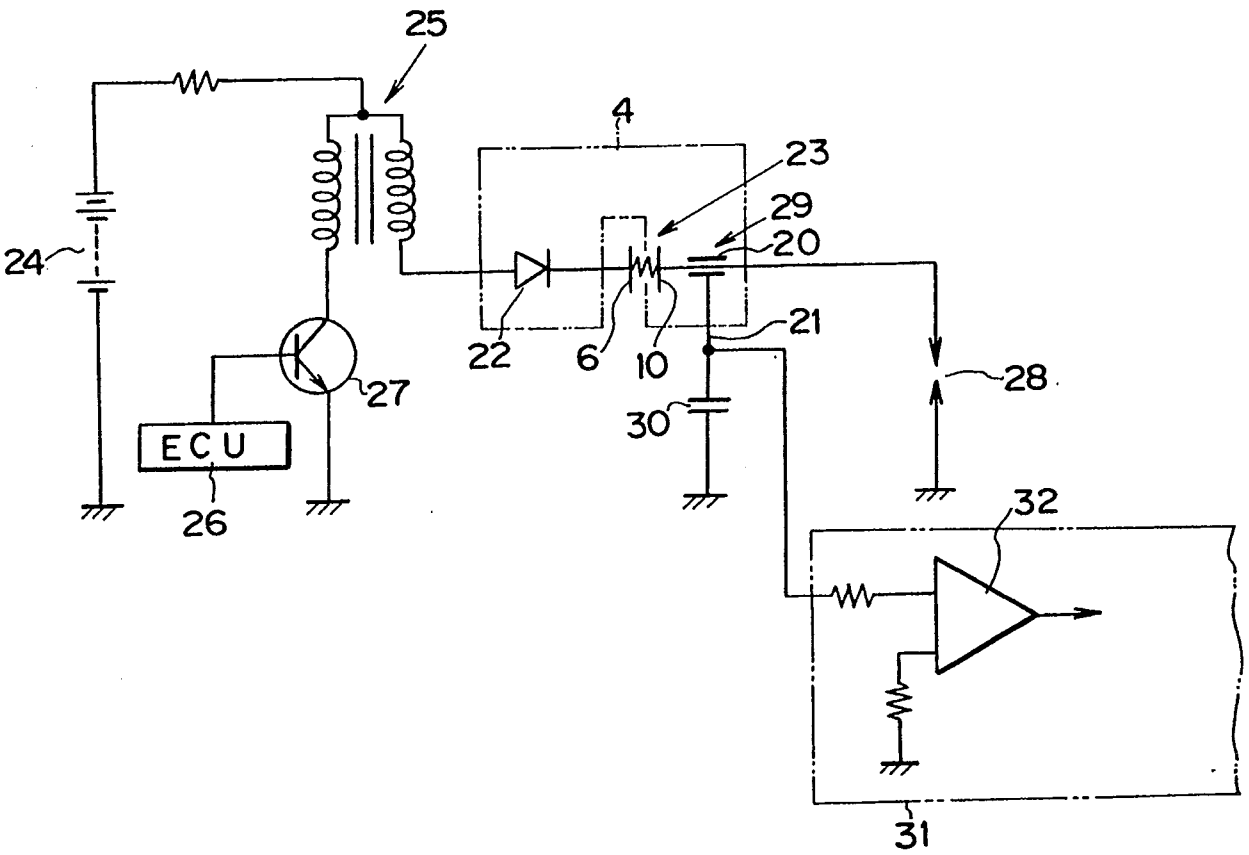
FIG. 2 is a wiring diagram showing the electrical circuitry of an ignition system utilizing the ignition distributor cap of FIG. 1.

FIG. 2 is a schematic diagram showing the electric circuitry of an ignition system utilizing an ignition distributor 23 including the ignition distributor cap 4 of FIG. 1. Also shown is an example of the input section of a misfire detector.

In FIG. 2, current flowing from a battery 24 through the primary winding of an ignition coil 25 is turned on and off by a power transistor 27 in response to ignition signals from an engine control unit 26. The high-voltage current induced in the secondary winding of the ignition coil 25 passes through the diode 22 serving as the current suppression means, the center electrode 6 and side terminal 10 of the ignition distributor 23, to the spark plug 28. As shown in FIG. 1, the detection capacitor 29 is constituted in the vicinity of each side terminal 10 of the ignition distributor 23 by the provision of the conductor 20. As also shown in FIG. 1, the diode 22 serving as the current suppression means and the detection capacitor 29 comprising the conductor 20 are built into the ignition distributor cap 4. The detection capacitor 29 is connected in series with a voltage divider capacitor 30 by the lead 21 shown in FIG. 1. The other terminal of the voltage divider capacitor 30 is grounded and an intermediate point between the detection capacitor 29 and the voltage divider capacitor 30 (the voltage division point) is connected with one terminal of an amplifier 32 on the input side of a misfire detector 31.

In the embodiment according to FIGS. 1 and 2, a high voltage is produced on the secondary winding of the ignition coil 25 every time an ignition signal from the engine control unit 26 causes the power transistor 27 to switch from the on state to the off state and thus cut off the supply of current to the primary winding of the ignition coil 25. The current produced by this high voltage passes through the diode 22 serving as the current suppression means and the center electrode 6 and side terminal 10 of the distributor 23 and then to the spark plug 28 where it produces a spark discharge between the terminals of the spark plug 28. The voltage of the current flowing through the conductor 11A in FIG. 1 at this time is capacitively divided by the voltage divider capacitor 30 and the detection capacitor 29 comprising the conductor 20 shown in FIG. 1, and the capacitance divided voltage is applied as a detection voltage to the misfire detector 31. The misfire detector 31 compares the wave form of the detection voltage with a reference wave form for discriminating the presence/absence of misfire.

As was explained earlier, when normal combustion does not occur and ions are therefore not produced at the gap between the electrodes of the spark plug 28, then, during the latter half of the discharge period, a current tends to be produced in the opposite direction from the direction of the normal discharge current. However, since this reverse current (tending to flow from the spark plug 28 toward the ignition coil 25) is suppressed by the diode 22 serving as the current suppression means, there is no possibility of the ignition voltage being canceled out by the reverse current. Thus, since there is no possibility of the wave form of the ignition voltage being disturbed by any such reverse current, accurate discrimination of the presence/absence of misfire is ensured at all times.

And, since the ignition distributor cap 4 is firmly fixed on the main ignition distributor unit 1 (the portion including the distributor rotor), there is likelihood of the ignition distributor cap vibrating. Moreover, since the conductor 20 for detection is formed integrally with the hard ignition distributor cap body, any vibration it does receive will not shift its position or deform it. In addition, since the conductor 20 for detection is located inside the ignition distributor cap 4, it is isolated from changes in humidity and other ambient conditions and is also safe from the invasion of oil, grime and the like from the outside.

Moreover, in the embodiment, the diode 22 is provided in the high-voltage conduction path for suppressing current flow in the reverse direction. This ensures that the wave form of the ignition voltage will not be obliterated at the time of misfire by the reverse flow of residual charge from the spark plug electrode gap that tends to occur during the latter half of the discharge period during misfire. It thus ensures that the ignition voltage wave form to be detected can be detected properly. Since the current suppressing means is installed in the high-voltage conduction path at a position further to the side of the ignition coil than the position at which the conductor for detection is provided, the voltage wave form across the spark plug electrode gap is reliably received at least up to the position of the conductor for detection. Thus the current suppressing means does not adversely affect the detection of the ignition voltage wave form.

For enhancing the accuracy of voltage wave form detection, it is preferable to maximize the static capacitance of the detection capacitor 29 by reducing as far as possible the distance D between the conductor 20 and the conductor 11A constituting the detection capacitor 29. However, reducing the distance D too far may lead to degradation of the insulation property by corona discharge and, therefore, may result in a high leak voltage being applied to the misfire detector through the conductor 20. In the embodiment shown in FIG. 1, a part of the resin (usually polybutylene terephthalate) forming the distributor cap 4 is present between the conductor 20 and the conductor 11A. Generally speaking, however, the insulation characteristics of a resin are inferior to those of ceramics and the like. Therefore, in a configuration in which only resin is present between the conductor 20 and the conductor 11A, it becomes necessary to establish a relatively large distance D so as to preclude insulation degradation owing to corona discharge. Since some sacrifice of static capacitance is therefore unavoidable, the degree to which the accuracy of ignition voltage wave form detection can be improved is limited.

Figure 3:
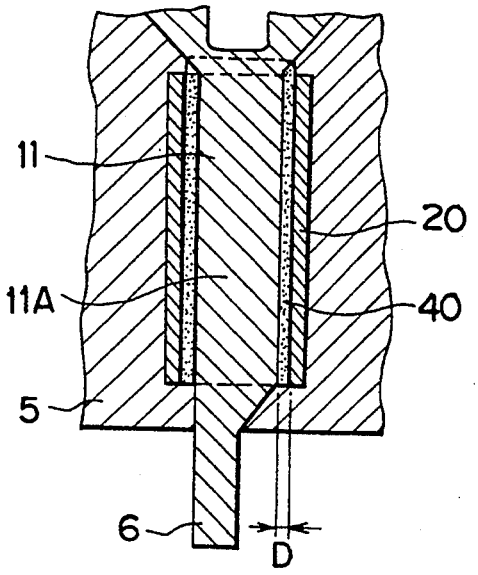
FIG. 3 is an enlarged vertical sectional view of a portion of an ignition distributor cap according to a second embodiment of the invention.

FIG. 3 shows an ignition distributor cap according to a second embodiment of the invention for solving this problem. As shown in the figure, an insert 40 made up of ceramic exhibiting excellent insulation characteristics is disposed between the inner surface of the conductor 20 and the conductor 11A to take the place of the intervening resin material. When a ceramic is used as the insert 40, it is convenient to bake or bond the ceramic onto the inner surface of the conductor 20 before forming the cap body 5 and then to embed the result integrally into the cap body 5 at the time of forming the cap body 5.

Figure 4:
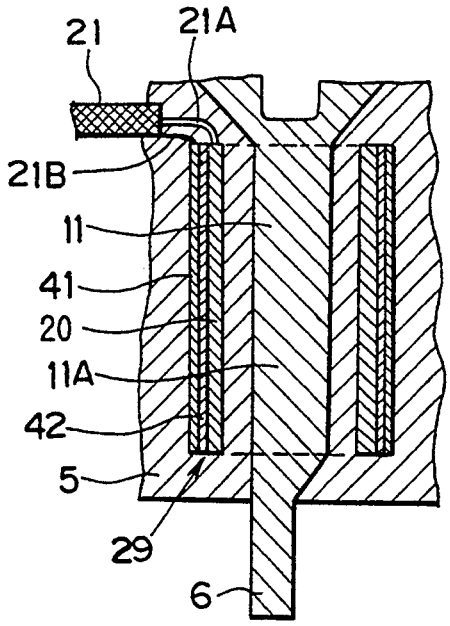
FIG. 4 is an enlarged vertical sectional view of a portion of an ignition distributor cap according to a third embodiment of the invention.

FIG. 4 shows an ignition distributor cap according to a third embodiment of the invention, in which a shield member 41 is provided around the conductor 20.

The shield member 41 of FIG. 4 is fabricated from screen, net, foil or thin sheet of a good conductor material such as copper or aluminum and is disposed to be concentric with the conductor 20 at a fixed distance outward thereof. An insulation layer 42 is sandwiched between the conductor 20 and the shield member 41. The insulation layer 42 can be formed of an epoxy resin or the like which also serves as a boding agent for bonding the shield member 41 to the outer surface of the conductor 20, or can be formed of the same type of hard synthetic resin as that constituting the cap body 5. In addition, the shield member 41 can be embedded integrally into the cap body 5 together with the distributor rotor 2 at the time of forming the cap body 5. In order for the shield member 41 to exhibit a shield effect it has to be electrically grounded. Where a shielded wire is used for the aforementioned lead 21, as is normally the case, the grounding of the shield member 41 can be easily accomplished by connecting the conductive core 21A of the lead 21 to the conductor 20 and connecting the electrically grounded outer shield member 21B of the lead 21 to the shield member 41. Lead 21 is connected to a second capacitor of the ignition voltage detection circuit as shown in FIG. 2.

In the embodiment, since the shield member 41 is provided to surround the conductor for detection. Therefore, even in a case where another conductive member is located near the distributor cap, there is little risk of the capacitance of the capacitor 29 for detection being caused to vary owing to changes in the distance between the ignition distributor cap and the conductive member or the capacitor for detection picking up noise from the conductive body.

Figure 5:
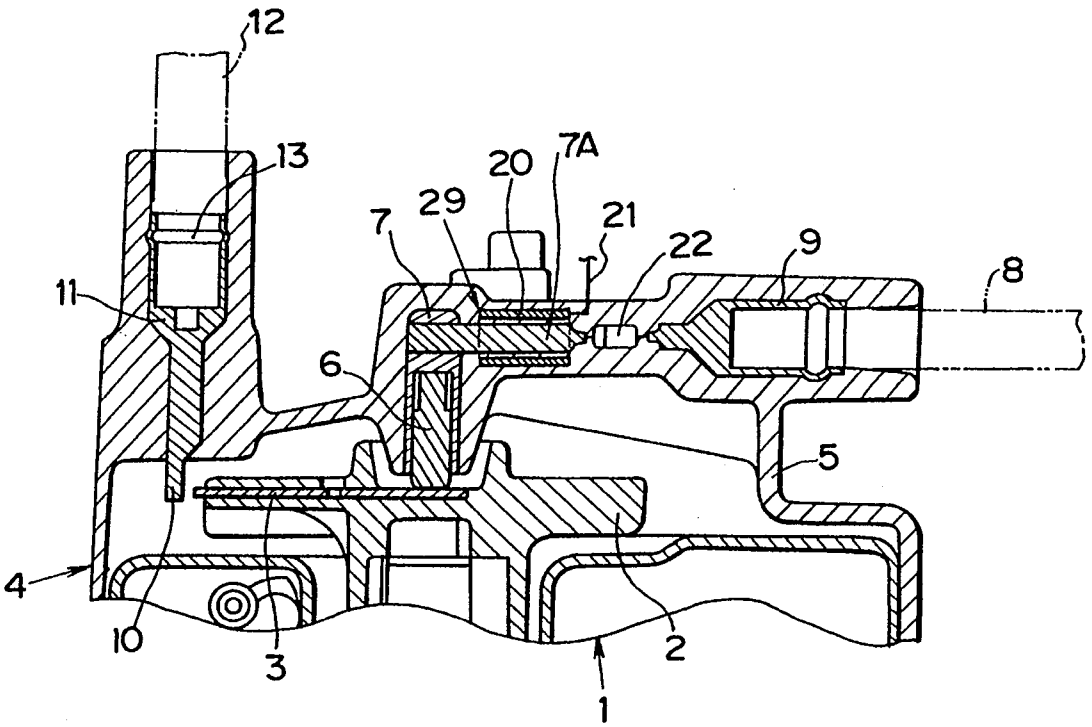
FIG. 5 is a vertical sectional view of an ignition distributor cap according to a fourth embodiment of the invention, also showing a part of the main distributor unit.

FIG. 5 shows an ignition distributor cap according to a fourth embodiment of the invention wherein the conductor 20 is provided on the high-voltage conduction path segment on the side of the center terminal section (coil contact tower) 7 (the conduction path segment nearer to the input side connector 9).

In the embodiment of FIG. 5, the conductor 20 is formed to enclose the high-voltage conductor path segment 7A at the center terminal section 7, more specifically to enclose the part of the high-voltage conductor path segment 7A between the input side connector 9 and the center electrode 6. As in the embodiment of FIG. 1, the conductor 20 is formed of a good conductor material such as copper or aluminum to have the shape of a hollow tube, a half tube(s) or a split tube(s) and is disposed concentrically with the high-voltage conductor path segment 7A so as to enclose the same. The conductor 20 and the high-voltage conductor path segment 7A, together with a portion of the resin of the cap body 5 present therebetween, constitute the detection capacitor 29. The lead 21 is connected with the conductor 20 and extended to the exterior. The diode 22 serving as the current suppression means is inserted into the high-voltage conductor path segment 7A of the center terminal section (coil contact tower) 7 at a point closer to the input side connector 9 then the point at which the conductor 20 is provided. The polarity of the diode 22 is set so as to suppress the flow of current in the direction from the center electrode 6 toward the input side connector 9 (i.e. current flow from the spark plug toward the ignition coil).

Similarly to the case of the embodiment of FIG. 1, in the embodiment of FIG. 5 the voltage wave form of the spark discharge is detected by the detection capacitor 29 constituted by the conductor 20 and the high-voltage conductor path segment 7A. The embodiment of FIG. 5 is also similar to that of FIG. 1 in that the diode 22 suppresses any reverse current produced in the ignition system. A particular feature of the fourth embodiment of FIG. 5 is that since the conductor 20 is provided on the center terminal section (coil contact tower) 7 side it suffices to provide only a single conductor 20 irrespective of the number of engine cylinders. The number of components required is therefore much smaller than in the case of the embodiment of FIG. 1.

Figure 6:
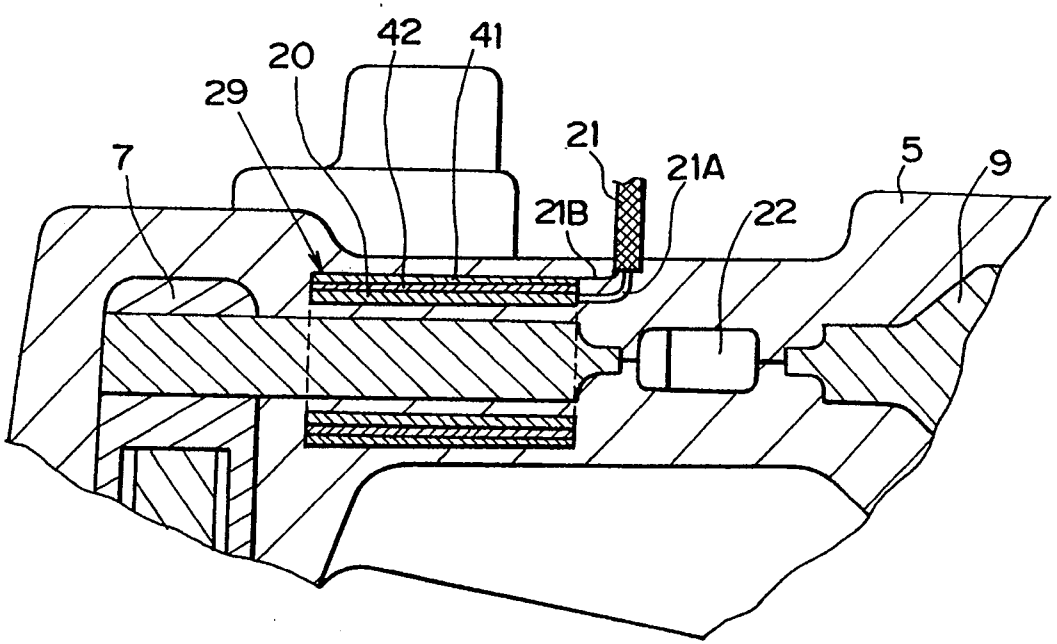
FIG. 6 is an enlarged vertical sectional view of a portion of an ignition distributor cap according to a fifth embodiment of the invention.

FIG. 6 shows an ignition distributor cap according to a fifth embodiment of the invention wherein the shield member 41 is provided. Since the configuration is basically the same as that of FIG. 4, it will not be explained further here.

It should be noted that, similarly to the embodiment of FIG. 3, the embodiments of FIGS. 5 and 6 can also be provided with inserts 40 to take the place of the resin present between the conductor 20 and the high-voltage conductor path segment 7A.

The present invention has thus been shown and described with reference to the specific embodiments. However, it should be noted that the present invention is in no way limited to the details of the described arrangements, changes and modification may be made without departing from the scope of the appended claims.

What is claimed is:

1. An ignition distributor cap covering the ignition distributor and having;

a coil contact tower connected to the secondary winding of an ignition coil of the engine;

spark plug terminals connected to spark plugs of the engine;

a rotor connecting the coil contact tower to one of the spark plug terminals with a gap to generate an electric path carrying ignition voltage current produced at the ignition coil to the spark plug;

an electric path connecting said coil contact tower, said spark plug terminals and said rotor; and an ignition voltage detector;

wherein the improvement comprising:

a conductor located around and at least partially encircling the electric path keeping a predetermined distance from the electric path and sandwiching an insulator for forming a first detection capacitor with the electric path, said first detection capacitor being plastic-molded integrally with said ignition distributor cap, said first detection capacitor constitutes a capacitive divider with a second capacitor, said second capacitor being grounded, said capacitive divider forming the ignition voltage detector.

2. An ignition distributor cap according to claim 1, wherein the conductor is located at the individual spark plug terminals.

3. An ignition distributor cap according to claim 2, wherein each of the spark plug terminals forms a connector for receiving a spark plug cable and plastic-molded integrally with a body of the ignition distributor cap, and the conductor is embedded in the plastic mold adjacent said connector.

4. An ignition distributor cap according to claim 3, wherein the conductor is a metal tube encircling a terminal of the connector.

5. An ignition distributor cap according to claim 3, wherein the conductor is metal tube segments encircling a terminal of the connector.

6. An ignition distributor cap according to claim 2, wherein a ceramic insulator is provided between the electric path and the conductor.

7. An ignition distributor cap according to claim 2, wherein the conductor is electrically shielded.

8. An ignition distributor cap according to claim 6, wherein the conductor is electrically shielded.

9. An ignition distributor cap according to claim 2, further including:

means for blocking current from flowing in the electric path from the spark plug to the ignition coil.

10. An ignition distributor cap according to claim 9, wherein said means is a diode provided in the electric path.

11. An ignition distributor cap according to claim 1, wherein the conductor is located at the coil contact tower.

12. An ignition distributor cap according to claim 11, wherein the coil contact tower forms a connector for receiving a coil cable and plastic-molded integrally with a body of the ignition distributor cap, and the conductor is embedded in the plastic mold.

13. An ignition distributor cap according to claim 12, wherein the conductor is a metal tube encircling a terminal of the connector.

14. An ignition distributor cap according to claim 12, wherein the conductor is metal tube segments encircling a terminal of the connector.

15. An ignition distributor cap according to claim 11, wherein a ceramic insulator is provided between the electric path and the conductor.

16. An ignition distributor cap according to claim 15, wherein the conductor is electrically shielded.

17. An ignition distributor cap according to claim 11, wherein the conductor is electrically shielded.

18. An ignition distributor cap according to claim 11, further including:

means for blocking current from flowing in the electric path from the spark plug to the ignition coil.

19. An ignition distributor cap according to claim 18, wherein said means is a diode provided in the electric path.

* * * * *